US005206209A

United States Patent [19]

Minami et al.

[11] Patent Number: 5,206,209

[45] Date of Patent: Apr. 27, 1993

[54] HEAT-SENSITIVE RECORDING SHEET

[75] Inventors: Toshiaki Minami; Tadakazu Fukuchi; Toshio Kaneko, all of Tokyo, Japan

[73] Assignee: Jujo Paper Co., Ltd., Tokyo, Japan

[21] Appl. No.: 683,548

[22] Filed: Apr. 10, 1991

[30] Foreign Application Priority Data

Apr. 10, 1990 [JP] Japan ..... 2-94429

[51] Int. Cl.[5] ..... B41M 5/30

[52] U.S. Cl. ..... 503/209; 427/150; 427/151; 503/216; 503/217; 503/221; 503/226

[58] Field of Search ..... 427/150–152; 503/209, 216, 217, 221, 225

[56] References Cited

U.S. PATENT DOCUMENTS 4,977,132 12/1990 Tsuchida et al. ..... 503/220

*Primary Examiner*—B. Hamilton Hess

*Attorney, Agent, or Firm*—Sherman and Shalloway

[57] ABSTRACT

A heat-sensitive recording sheet of this invention comprises in a heat-sensitive color-developing layer both bis(4-hydroxyphenyl)butylacetate as an organic color-developing agent and a particular fluorane-leuco dye. This sheet provides an intense clear image less discoloration and superior heat-resistant preservability.

10 Claims, No Drawings

HEAT-SENSITIVE RECORDING SHEET

BACKGROUND OF THE INVENTION

1. Field of the Invention

This invention relates to a heat-sensitive recording sheet which is superior in the heat resistance of the background, and the water resistance, oil resistance and heat resistance of image.

2. Prior Art

In general, a heat-sensitive recording sheet is produced by applying on a support, such as paper, synthetic paper, film, plastic, etc., a coating material which is prepared by individually grinding and dispersing a colorless chromogenic dye and an organic color-developing agent, such as phenolic material, etc., into fine particles, mixing the resultant dispersions with each other and then adding thereto binder, filler, sensitizer, slipping agent and other auxiliaries. The coating, when heated by thermal pen, thermal head, hot stamp, laser beam, etc., undergoes instantaneously a chemical reaction which forms a color. These heat-sensitive recording sheets have now been finding a wide range of applications, including industrial measurement recording instruments, terminal printers of computer, facsimile equipment, automatic ticket vending machines, printer for bar-code-label, and so on. In recent years, as the application of such recording is diversified and the performance of such recording equipment is enhanced, high qualities are required for heat-sensitive recording sheets. For example, even with small heat energy in a high speed recording, both the clear image with a high density and the better preservability such as better resistance to light, weather and oil, etc. are required. The conventional heat-sensitive recording sheets are disclosed, for examples, in the Japanese Patent Publication Nos. 43-4160 and 45-14039.

However, these heat-sensitive recording sheets have as a defect, for example, an insufficient image density in high speed recording owing to the inferior thermal responsibility.

As the methods for improving the above defect, there have been developed the high sensitive dyes, for example, 3-N-methyl-N-cyclohexylamio-6-methyl-7-anilinofluorane (in the Japanese Patent Laid-Open No. 49-109120) and 3dibutylamino-6-methyl-7-anilinofluorane (in the Japanese Patent Laid Open No. 59-190891) as leuco dye. Further, there have been proposed the color-developing agents of superior color-formation, for example, 1,7-bis(4-hydroxyphenylthio)-3,5-dioxaheptane (in the Japanese Patent Laid-Open 59-106456), 1,5-bis(4-hydroxyphenylthio)-3-oxaheptane (in the Japanese Patent Laid-Open No. 59-116262) and 4-hydroxy-4'-isopropoxydiphenylsulfone (in the Japanese Patent Publication No. 63-46067). Using these chemicals, the technologies for the recording with high speed and sensitivity have been disclosed.

Although these heat-sensitive recording sheets provide a high sensitivity, they have a problem in an inferior heat-resistance, i.e. a formation of background fogging in the high temperature storage.

Further, they exhibit the extremely inferior preservability of the recorded image, which causes the following defects. In the adhesion to moisture or serum, or in the contact with plasticizer (DOP, DOA, etc.) in a wrapping film, the image density is prominently decreased or the recorded image disappears.

Further, Japanese Patent Application No. 1-267590 discloses a technique providing a heat-sensitive recording sheet which is superior in heat resistance, water resistance and oil resistance. In this case, however, there are problems in that a heat-recording sheet is inferior in preservability(heat-, water-, and oil-resistance), somewhat insufficient dynamic image density and causes slight formation of background fogging.

SUMMARY OF THE INVENTION

It is the object of this invention to provide a heat-sensitive recording sheet which has a sufficient dynamic image density, and which is superior in preservability (heat-, water-, and oil-resistance) and causes no formation of background fogging.

The above object can be performed as follows. The heat-sensitive recording sheet comprises a support having thereon a color-developing layer which comprises both bis-(4-hydroxyphenyl)-butylacetate, a particular diphenol compound, as an organic color-developing agent and at least one fluoraneleuco dye selected from 3-n-dipentylamino-6-methyl-7-anilinofluorane represented by the following formula (I), 2-(4-oxa-hexyl)-3-dimethylamino-6-methyl-7-anilinofluorane represented by the following formula (II), 2-(4-oxa-hexyl)-3-diethylamino-6-methyl-7-anilinofluorane represented by the following formula (III) and 2-(4-oxa-hexyl)-3-dipropylamino-6-methyl-7-anilinofluorane represented by the following formula (IV).

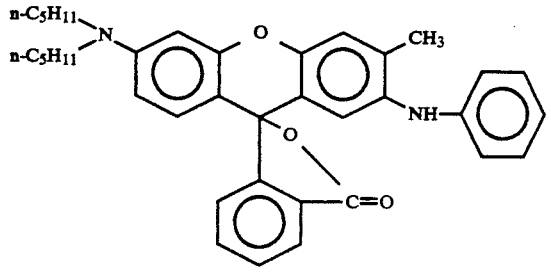

(I)

-continued

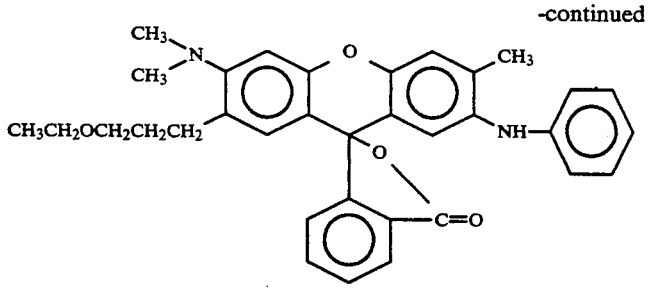

(II)

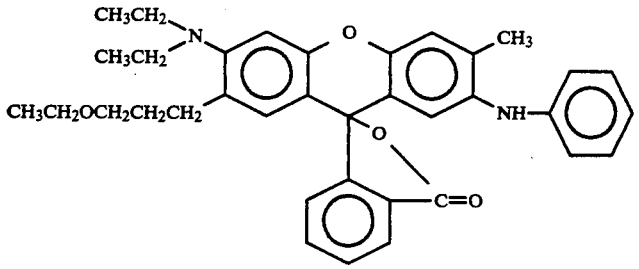

(III)

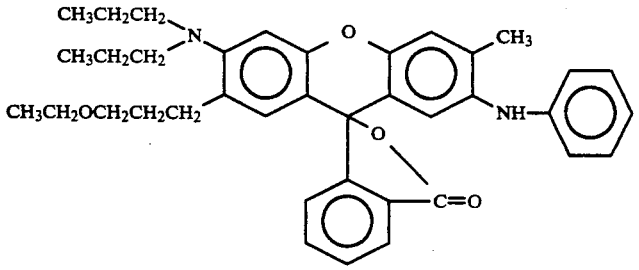

(IV)

DETAILED DESCRIPTION OF THE INVENTION

The fluorane-leuco dye of this invention can be used in combination with other fluorane-leuco dyes in such a range that the effects of this invention is not deteriorated. Typical examples for these fluorane-leuco dyes include: 3-diethylamino-6-methyl-7-anilinofluorane, 3-(N-ethyl-P-toluidino)-6-methyl-7-anilinofluorane, 3-(N-ethyl-N-isoamylamino)-6-methyl-7-anilinofluorane, 3-diethylamino-6-methyl-7-(o,p-dimethylanilino)fluorane, 3-pyrolidino-6-methyl-7-anilinofluorane, 3-piperidino-6-methyl-7-anilinofluorane, 3-(N-cyclohexyl-N-methylamino)-6-methyl-7-anilinofluorane, 3-diethylamino-7-(m-trifluoromethylanilino)fluorane, 3-dibuthylamino-6-methyl-7-anilinofluorane, 3-diethylamino-6-chlor-7-anilinofluorane, 3-dibutylamino-7-(o-chloranilino) fluorane and 3-diethylamino-7-(o-chloranilino) fluorane.

As in the dye of this invention, the color-developing agent of this invention can be used in combination with the other color-developing agents in such a range that the effects are not deteriorated.

As sensitizers, there can be used fatty acid amide such as stearic acid amide, palmitic acid amide; ethylenebis amide; montan wax; polyethylene wax; dibenzyl terephthalate; benzyl p-benzyloxybenzoate; d-p-tolylcarbonate; p-benzylbiphenyl, phenyl $\alpha$-naphthylcarbonate; 1,4-diethoxynaphthalene; 1-hydroxy-2-naphthoic acid phenyl ester; 1,2-di(3-methylphenoxy) ethane; di(p-methylbenzyl) oxalate; $\beta$-benzyloxynaphthalene; 4-biphenyl-p-tolylether; and the like.

As the binders of this invention, there can be mentioned, for example, a fully saponified polyvinyl alcohol having a polymerization degree of 200 ~1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/maleic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyral, polystyrol and copolymers thereof; polyamide resin, silicone resin, petroleum resin, terpene resin, ketone resin and cumaron resin.

These polymeric materials may be used after they were dissolved in an solvent such as water, alcohol, ketone, ester, hydrocarbon, etc., or after they were emulsified or dispersed in water or a solvent other than water.

These binders can be used in combination depending upon the required quality.

Further, metal salts of p-nitrobenzoic acid (Ca-and Zn-salts) or metal salts of phthalic acid monobenzylester (Ca- and Zn-salts) as known stabilizers can be added thereto.

The filler used in this invention includes organic and inorganic fillers. Typical examples for fillers include silica, calcium carbonate, kaolin, calcined kaolin, diatomaceous earth, talc, titanium dioxide and aluminum hydroxide.

Furthermore, the following additives can be used: releasing agent such as fatty acid metal salts, slipping agent such as waxes, UV-absorbers of benzophenone type or triazole type, water resistance agent such as glyoxal, dispersants, antifoamers and the like.

The species and the amount of organic color-developing agent, colorless basic chromogenic dye and other ingredients, which are used in this invention, are determined depending upon the performance and recording aptitude required for the recording sheet, and are not otherwise limited. However, in ordinary cases, it is suitable to use 1-8 parts by weight of organic color-developing agent, 1-20 parts by weight of filler, based on 1 part by weight of colorless basic chromogenic dye, and to add 10-25% by weight of a binder in total solid content.

The aimed heat-sensitive recording sheet may be obtained by coating the above coating material on a substrate such as paper, synthetic paper, film, plastic, etc.

For improving the preservability, further, an overcoat layer of a polymer, etc. containing a filler is formed on the color-developing layer.

For improving the preservability and sensitivity, an undercoat layer containing an organic or inorganic filler is formed under the color-developing layer.

The above organic color-developing agent, the above colorless basic chromogenic dye, and if necessary, other ingredients are ground to a particle size of several microns or smaller by means of a grinder or emulsifier such as a ball mill, attritor, sand grinder, etc., and binders and various additives in accordance with the purpose, are added thereto to prepare a coating material.

The reason for providing the effects of this invention in the combined use of a particular color-developing agent and a particular dye is thought as follows.

The reason for the superior dynamic image density is due to the fact that the dye has a high melting, dissolving and diffusion speed, as well as a great saturation solubility into the color-developing agent of this invention to thereby form a recorded image instantaneously on contact with thermal heads of high temperature.

The reason why the recorded image is superior in water resistance and oil resistance is explained as follows. Generally, a heat-sensitive recording sheet is composed of a colorless basic dye as an electron donor and of an organic acidic material, such as phenolic material, aromatic carboxylic acid, organic sulfonic acid, etc. as an electron acceptor. The heat-melt reaction between the colorless basic dye and the color-developing agent is an acid-base reaction based on the donating-acceptance of electrons, whereby a pseudo-stable "electron charge transfer complex" is produced, which forms a color.

In the use of bis(4-hydroxyphenyl)butylacetate as an organic color-developing agent, the chemical binding force in color-forming reaction between bis(4-hydroxyphenyl)butylacetate and a particular fluorane-leuco dye as a colorless basic dye is prominently strong, in comparison with that in color-forming reaction between a fluorane-leuco dye and a color-developing agent other than that of this invention.

The color-developing agent other than that of this invention includes, for example, 4-hydroxy benzoic acid benzyl ester, 4-hydrxy-4'-isopropoxydiphenylsulfone, 1,7-di(4-hydroxyphenylthio)-3,5-dioxaheptane and 4,4'-dihydroxydiphenylsulfone. Owing to the strong chemical binding force, the chemical bonding do not deteriorate for a long period even under the circumstance of heat, water, oil, etc., so that a record image is stable.

EXAMPLES

The following examples illustrate this invention, although this invention is not limited to examples. The parts are parts by weight.

EXAMPLE 1 (Test Nos. 1-3)

| | |
|---|---|
| Liquid A (dispersion of dye) | |
| Dye (see Table 1) | 2.0 parts |
| 10% aqueous solution of polyvinyl alcohol | 4.6 parts |
| Water | 2.5 parts |
| Liquid B (dispersion of color-developing agent) | |
| bis(4-hydroxyphenyl)butylacetate | 6.0 parts |
| 10% aqueous solution of polyvinyl alcohol | 18.8 parts |
| Water | 11.2 parts |

Each liquid of the above composition was ground to an average particle size of 1 micron by a sand grinder. Then, the dispersions were mixed in the following proportion to prepare a coating material.

| Coating material | |
|---|---|
| Liquid A (dispersion of dye) | 9.1 parts |
| Liquid B (dispersion of color-developing agent) | 36.0 parts |
| Kaolin clay (50% aqueous dispersion) | 12.0 parts |

The coating material was applied on one side of a base paper weighing 50 g/m$^2$ in a coating weight of 5.0 g/m$^2$ and then dried. The resultant paper was treated to a smoothness of 400-500 seconds by a supercalender. In this manner, a heat-sensitive recording sheet was obtained.

Comparative Example 1-2

A heat-sensitive recording sheet was obtained in the same manner as in Example 1 except that the dye in Table 1 is used instead of the dye of Liquid A.

Comparative Example 3-6

| | |
|---|---|
| Liquid C (dispersion of dye) | |
| Dye (see Table 1) | 2.0 parts |
| 10% aqueous solution of polyvinyl alcohol | 4.6 parts |
| Water | 2.5 parts |
| Liquid D (dispersion of color-developing agent) | |
| Color-developing agent (see Table 1) | 6.0 parts |
| 10% aqueous solution of polyvinyl alcohol | 18.8 parts |
| Water | 11.2 parts |

Each liquid of the above composition was ground to an average particle size of 1 micron by a sand grinder. Then, the dispersions were mixed in the following proportion to prepare a coating material.

| Coating material | |
|---|---|
| Liquid C (dispersion of dye) | 9.1 parts |
| Liquid D (dispersion of color-developing agent) | 36.0 parts |
| Kaolin clay (50% aqueous dispersion) | 12.0 parts |

The coating material was applied on one side of a base paper weighing 50 g/m$^2$ in a coating weight of 5.0 g/m$^2$ and then dried. The resultant paper was treated to a smoothness of 400-500 seconds by a supercalender. In this manner, a black color-forming heat-sensitive recording sheet was obtained.

EXAMPLES 5-6

| | |
|---|---|
| Liquid A (dispersion of dye) | |
| Dye (see Table 2) | 2.0 parts |
| 10% aqueous solution of polyvinyl alcohol | 4.6 parts |
| Water | 2.5 parts |
| Liquid B (dispersion of color-developing agent) | |
| Bis(4-hydroxphenyl)butylacetate | 6.0 parts |
| 10% aqueous solution of polyvinyl alcohol | 18.8 parts |
| Water | 11.2 parts |

Each liquid of the above composition was ground to an average particle size of 1 micron by a sand grinder. Then, the dispersions were mixed in the following proportion to prepare a coating material.

| Coating material | |
|---|---|
| Liquid A (dispersion of dye) | 9.1 parts |
| Liquid B (dispersion of color-developing agent) | 36.0 parts |
| Kaolin clay (50% aqueous dispersion) | 12.0 parts |

The coating material was applied on one side of a base paper weighing 50 g/m$^2$ in a coating weight of 5.0 g/m$^2$ and then dried. The resultant paper was treated to a smoothness of 400-500 seconds by a supercalender. In this manner, a black color-forming heat-sensitive recording sheet was obtained.

Comparative Examples 7-8

| | |
|---|---|
| Liquid A (dispersion of dye) | |
| Dye (see Table 2) | 2.0 parts |
| 10% aqueous solution of polyvinyl alcohol | 4.6 parts |
| Water | 2.5 parts |
| Liquid E (dispersion of color-developing agent) | |
| 4-Hydroxy-4'-n-propoxydiphenylsulfone | 6.0 parts |
| 10% aqueous solution of polyvinyl alcohol | 18.8 parts |
| Water | 11.2 parts |

Each liquid of the above composition was ground to an average particle size of 1 micron by a sand grinder. Then, the dispersions were mixed in the following proportion to prepare a coating material.

| Coating material | |
|---|---|
| Liquid A (dispersion of dye) | 9.1 parts |
| Liquid E (dispersion of color-developing agent) | 36.0 parts |
| Kaolin clay (50% aqueous dispersion) | 12 parts |

The coating material was applied on one side of a base paper weighing 50 g/m$^2$ in a coating weight of 5.0 g/m$^2$ and then dried. The resultant paper was treated to a smoothness of 400-500 seconds by a supercalender. In this manner, a black color-forming heat-sensitive recording sheet was obtained.

The heat-sensitive recording sheets obtained by the above Example and Comparative Examples were tested for their qualities and performances. The test results are summarized in Tables 1 and 2.

Notes (1) Dynamic image density:

A heat-sensitive recording sheet is recorded with an impressed voltage of 18.03 volts and a pulse width of 3.2 milli-seconds by using the thermal facimile KB-4800 manufactured by TOSHIBA CORPORATION, and the optical density of the recorded image is measured by a Macbeth densitometer (RD-914, using amber filter which is employed in other samples).

(2) Heat resistance:

A heat-sensitive sheet before the recording allows to stand for 24 hours at 60° C., and the image density is measured by a Macbeth densitometer.

(3) Water-resistance:

The heat-sensitive recording sheet recorded in Note (1) is dipped in water at 20° C. for 24 hours. After drying, the recorded image is measured by a Macbeth densitometer. Residual rate is calculated from the following equation.

$$\text{Residual rate} = \frac{\text{Image density after water treatment}}{\text{Image density before water treatment}} \times 100\ (\%)$$

(4) Oil-resistance:

The image density obtained in Note (1) is defined as image density before oil treatment. A drop of salad oil is applied on the recorded image, and wished off with a filter paper after 10 secs. The obtained paper allows to stand for 1 hour at room temperature. Residual rate is calculated from the following equation.

$$\text{Residual rate} = \frac{\text{Image density after oil treatment}}{\text{Image density before oil treatment}} \times 100\ (\%)$$

(5) Heat-resistant preservability:

The heat-sensitive recording sheet recorded in Note (1) allows to stand for 24 hours at 60° C., and the recorded density is measured by a Macbeth densistometer.

Residual rate is calculated from the following equation.

$$\text{Residual rate} = \frac{\text{Image density after heat treatment}}{\text{Image density before heat treatment}} \times 100\ (\%)$$

TABLE 1

Test Results

| | Color-developing agent | Dye | (1) Dynamic image density | (2) Heat resistance Before treatment | (2) Heat resistance After treatment |
|---|---|---|---|---|---|
| Example 1 | Bis(4-hydroxyphenyl)butylacetate | 3-n-Dipentylamino-6-methyl-7-anilinofluorane | 1.32 | 0.05 | 0.07 |

TABLE 1-continued

| | | | Test Results | | |
|---|---|---|---|---|---|
| 2 | Bis(4-hydroxyphenyl)butyl-acetate | 2-(4-Oxa-hexyl)-3-dimethylamino-6-methyl-7-anilinofluorane | 1.30 | 0.05 | 0.07 |
| 3 | Bis(4-hydroxyphenyl)butyl-acetate | 2-(4-Oxa-hexyl)-3-diethylamino-6-methyl-7-anilinofluorane | 1.31 | 0.05 | 0.08 |
| 4 | Bis(4-hydroxyphenyl)butyl-acetate | 2-(4-Oxa-hexyl)-3-dimethylamino-6-methyl-7-anilinofluorane | 1.29 | 0.05 | 0.07 |
| Comparative Example | | | | | |
| 1 | Bis(4-hydroxyphenyl)butyl-acetate | 3-(N-Cyclohexyl-N-methylamino)-6-methyl-7-anilinofluorane | 1.21 | 0.06 | 0.11 |
| 2 | Bis(4-hydroxyphenyl)butyl-acetate | 3-Dibutylamino-6-methyl-7-anilinofluorane | 1.24 | 0.06 | 0.09 |
| 3 | 4-Hydroxy benzoic acid benzyl ester | 3-n-Dipentylamino-6-methyl-7-anilinofluorane | 1.30 | 0.06 | 0.13 |
| 4 | 4-Hydroxy-4'-isopropoxydiphenyl sulfone | 3-n-Dipentylamino-6-methyl-7-anilinofluorane | 1.29 | 0.06 | 0.10 |
| 5 | 1,7-Di(4-hydroxy-phenylthio)-3,5-dioxaheptane | 2-(4-Oxa-hexyl)-3-dimethylamino-6-methyl-7-anilinofluorane | 1.30 | 0.06 | 0.12 |
| 6 | 4,4'-Dihydroxy-diphenylsulfone | 2-(4-Oxa-hexyl)-3-diethylamino-6-methyl-7-anilinofluorane | 1.00 | 0.07 | 0.14 |

| | (3) Water resistance | | | (4) Oil resistance | | |
|---|---|---|---|---|---|---|
| | Before treat-ment | After treat-ment | Residual rate (%) | Before treat-ment | After treat-ment | Residual rate (%) |
| Example | | | | | | |
| 1 | 1.32 | 1.18 | 89 | 1.32 | 1.21 | 92 |
| 2 | 1.30 | 1.19 | 92 | 1.30 | 1.18 | 91 |
| 3 | 1.31 | 1.20 | 92 | 1.31 | 1.21 | 92 |
| 4 | 1.29 | 1.16 | 90 | 1.29 | 1.18 | 91 |
| Comparative Example | | | | | | |
| 1 | 1.21 | 0.95 | 79 | 1.21 | 0.97 | 80 |
| 2 | 1.24 | 0.98 | 79 | 1.24 | 0.96 | 77 |
| 3 | 1.30 | 1.01 | 78 | 1.30 | 0.84 | 65 |
| 4 | 1.29 | 1.04 | 81 | 1.29 | 1.06 | 82 |
| 5 | 1.30 | 1.04 | 80 | 1.30 | 0.94 | 72 |
| 6 | 1.00 | 0.60 | 61 | 1.00 | 0.77 | 77 |

TABLE 2

| | Color-developing agent | Dye | Heat-resistant preservability | | |
|---|---|---|---|---|---|
| | | | Before treat-ment | After treat-ment | Residual rate(%) |
| Example 5 | Bis(4-hydroxy-phenyl)butyl-acetate | 3-n-Dipentyl-amino-6-methyl-7-anilinofluorane | 1.32 | 1.28 | 97 |
| Example 6 | Bis(4-hydroxy-phenyl)butyl-acetate | 2-(4-Oxa-hexyl)-3-dimethylamino-6-methyl-7-anlinofluorane | 1.30 | 1.26 | 97 |
| Comparative Example 7 | 4-Hydroxy-4'-n-pro-poxydiphenyl-sulfone | 3-n-Dipentyl-amino-6-methyl-7-anilinofluorane | 1.31 | 0.98 | 75 |
| Comparative Example 8 | 4-Hydroxy-4'-n-pro-poxydiphenyl-sulfone | 2-(4-Oxa-hexyl)-3-dimethylamino-6-methyl-7-anilinofluorane | 1.30 | 0.99 | 76 |

The advantageous features of the heat-sensitive recording sheets obtained by this invention are as follows:

(1) An intense, clear image in high-speed and high-density recording owing to excellent thermal responsibility, (2) Less discoloration of the recorded image on contact with plasticizer, (3) Less discoloration of the recorded image on contact with moisture, (4) Stable brightness under the condition of high temperature, (5) Stable image under the condition of high temperature (superior heat-resistant preservability)

We claim:

1. A heat-sensitive recording sheet comprising a support having thereon a color-developing layer which comprises as main ingredients a colorless or pale colored basic chromogenic dye and an organic color-developing agent, wherein said color-developing layer comprises both bis(4-hydroxyphenyl)butylacetate as an organic color-developing agent and at least one fluorane-leuco dye selected from dyes represented by the following formulae (I), (II), (III) and (IV) as a colorless or pale colored basic chromogenic dye:

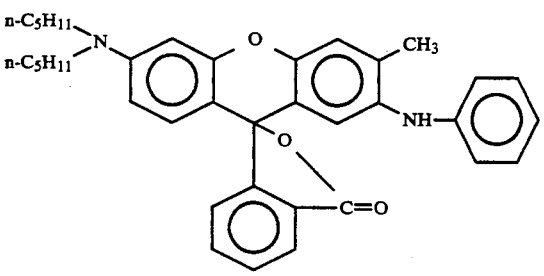

(I)

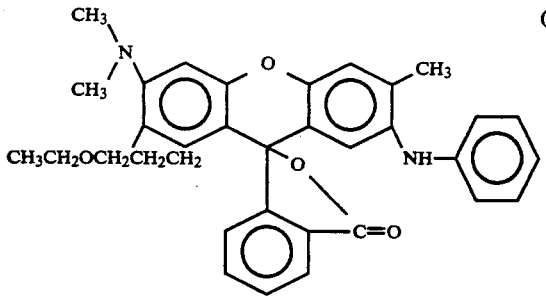

(II)

-continued

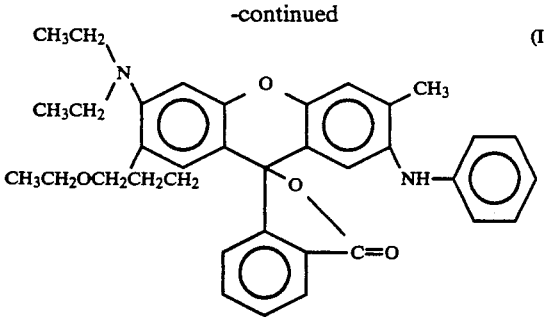

(III)

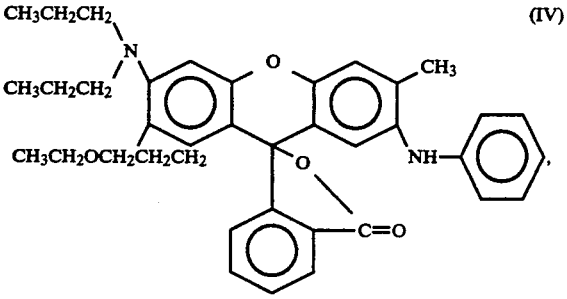

(IV)

2. The heat-sensitive recording sheet according to claim 1, wherein said color-developing layer comprises 1–8 parts by weight of said organic color-developing agent and 1–20 parts by weight of filler, based on 1 part by weight of said colorless basic chromogenic dye, and 10–25% by weight of binder in total solid content.

3. The heat sensitive recording sheet according to claim 1, wherein said color-developing layer further comprises a stabilizer.

4. The heat-sensitive recording sheet according to claim 3, wherein said stabilizer is at least one material selected from the group consisting of metal salts of p-nitrobenzoic acid and metal salts of phthalic acid monobenzylester.

5. The heat-sensitive recording sheet according to claim 1, wherein said color-developing layer further comprises fluorane-leuco dyes other than said fluorane-leuco dyes represented by the formulae (I), (II), (III), and (IV).

6. The heat-sensitive recording sheet according to claim 1, wherein said support is at least one member selected from the group consisting of paper and plastic.

7. The heat-sensitive recording sheet according to claim 6, wherein said paper is a synthetic paper.

8. The heat-sensitive recording sheet according to claim 1, wherein an over-coat layer is formed on said color-developing layer.

9. The heat-sensitive recording sheet according to claim 1, wherein an under-coat layer is formed under said color-forming layer.

10. The heat-sensitive recording sheet according to claim 1, wherein said support is a film.

* * * * *